US009210491B2

(12) United States Patent
Tinaphong et al.

(10) Patent No.: US 9,210,491 B2
(45) Date of Patent: Dec. 8, 2015

(54) WIRELESS AUDIO COUPLER AND AMPLIFIER FOR MOBILE PHONE, TABLET DEVICE, MP3 PLAYER AND THE LIKE

(71) Applicant: VOXX International Corporation, Hauppauge, NY (US)

(72) Inventors: Prapan Paul Tinaphong, Carmel, IN (US); John Anthony Andrews, Indianapolis, IN (US); Songling Zhao, Carmel, IN (US); Nathan T. Frame, Indianapolis, IN (US); S Ian Geise, Carmel, IN (US); David A. Benedetti, Carmel, IN (US); Kevin Kei Kwan Lee, Victoria (AU)

(73) Assignee: VOXX International Corporation, Hauppauge, NY (US)

( * ) Notice: Subject to any disclaimer, the term of this patent is extended or adjusted under 35 U.S.C. 154(b) by 192 days.

(21) Appl. No.: 14/109,218

(22) Filed: Dec. 17, 2013

(65) Prior Publication Data

US 2014/0169605 A1 Jun. 19, 2014

Related U.S. Application Data

(63) Continuation-in-part of application No. 29/466,502, filed on Sep. 9, 2013.

(60) Provisional application No. 61/738,545, filed on Dec. 18, 2012, provisional application No. 61/836,472, filed on Jun. 18, 2013.

(51) Int. Cl.
*H04R 1/02* (2006.01)
*H04R 1/28* (2006.01)

(52) U.S. Cl.
CPC ..... *H04R 1/028* (2013.01); *H04R 1/2834* (2013.01); *H04R 2420/07* (2013.01); *H04R 2430/01* (2013.01)

(58) Field of Classification Search
CPC ..... H04R 2499/11; H04R 5/02
USPC ..... 381/334
See application file for complete search history.

(56) References Cited

U.S. PATENT DOCUMENTS

| | | | | |
|---|---|---|---|---|
| 7,151,836 | B1 | 12/2006 | Funahashi et al. | 381/150 |
| 2011/0059696 | A1 | 3/2011 | Rasmussen et al. | 455/41.1 |
| 2011/0131358 | A1* | 6/2011 | Ganesh | G01C 21/265 710/304 |
| 2012/0060109 | A1* | 3/2012 | Han | G06F 3/1454 715/769 |
| 2013/0267284 | A1* | 10/2013 | Ryu | H04W 88/06 455/575.7 |

FOREIGN PATENT DOCUMENTS

| | | | |
|---|---|---|---|
| CN | 2010 25733 | 2/2008 | H04R 27/00 |
| WO | WO 00/60599 | 10/2000 | G11C 7/16 |

OTHER PUBLICATIONS

The Notification of Transmittal of the International Search Report International Search Report and the Written Opinion Report of the International Search Authority, or the Declaration, dated Apr. 24, 2014, the International Search Report, dated Apr. 24, 2014 and the Written Opinion of the International Searching Authority, dated Mar. 31, 2014, issued from WIPO for Applicant's corresponding PCT Application No. PCT/US13/075696, filed Dec. 17, 2013.

* cited by examiner

*Primary Examiner* — Simon King
(74) *Attorney, Agent, or Firm* — Gerald T. Bodner

(57) ABSTRACT

An electronic amplifier device amplifies magnetic audio signals emanating from a portable electronic device placed thereon. The electronic amplifier device includes a housing having a designated area for placement of the portable electronic device thereon, an amplifier circuit, and at least one loudspeaker electrically coupled to the amplifier circuit. A wireless audio coupler circuit situated within the electronic amplifier device includes a magnetic signal pick-up coil which is situated in close proximity to the designated area on the housing. The magnetic signal pick-up coil senses magnetic signals emanating from the portable electronic device placed on the designated area of the housing, and the electronic amplifier device amplifies these signals and provides them to the loudspeaker.

13 Claims, 13 Drawing Sheets

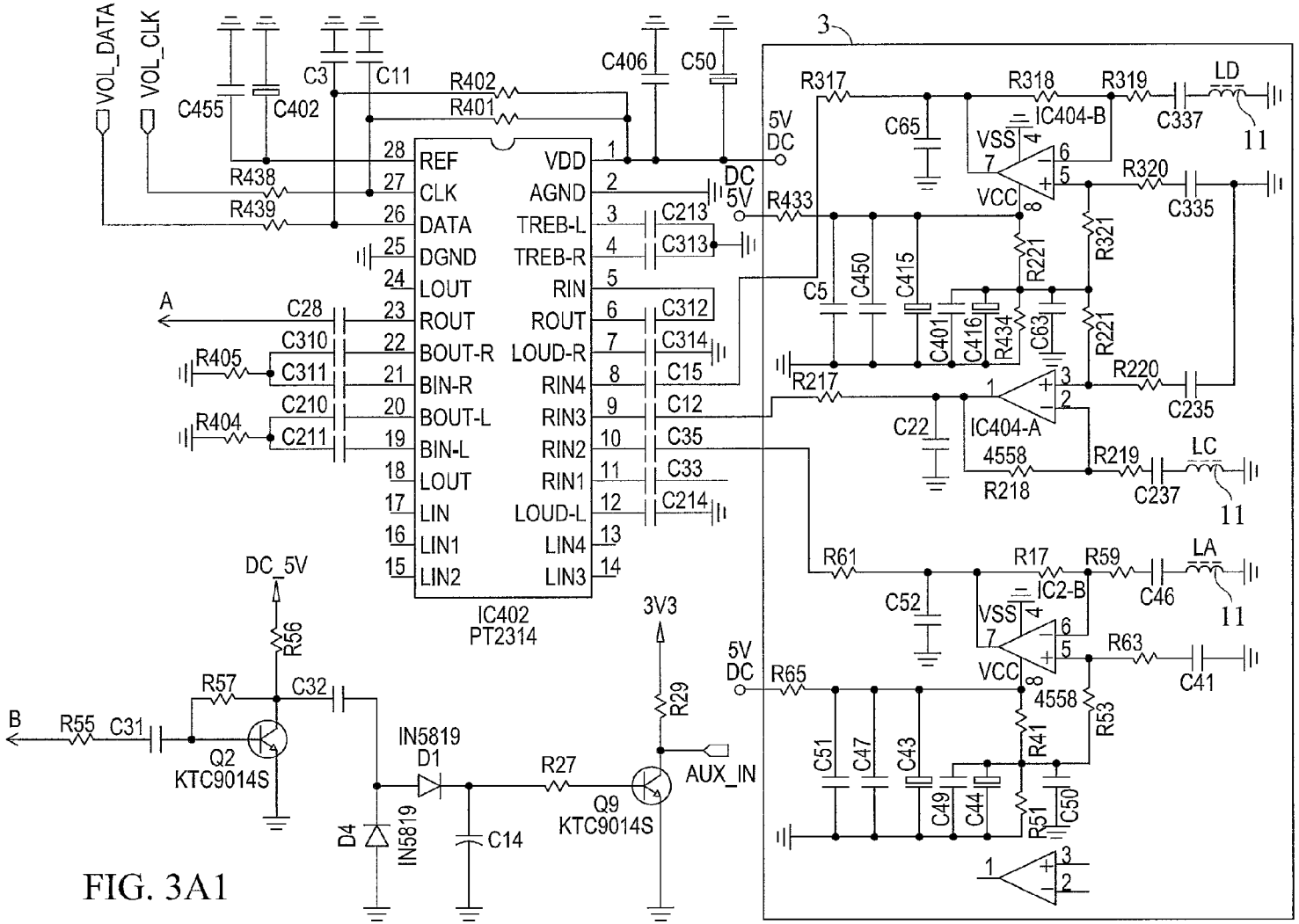
FIG. 3A1

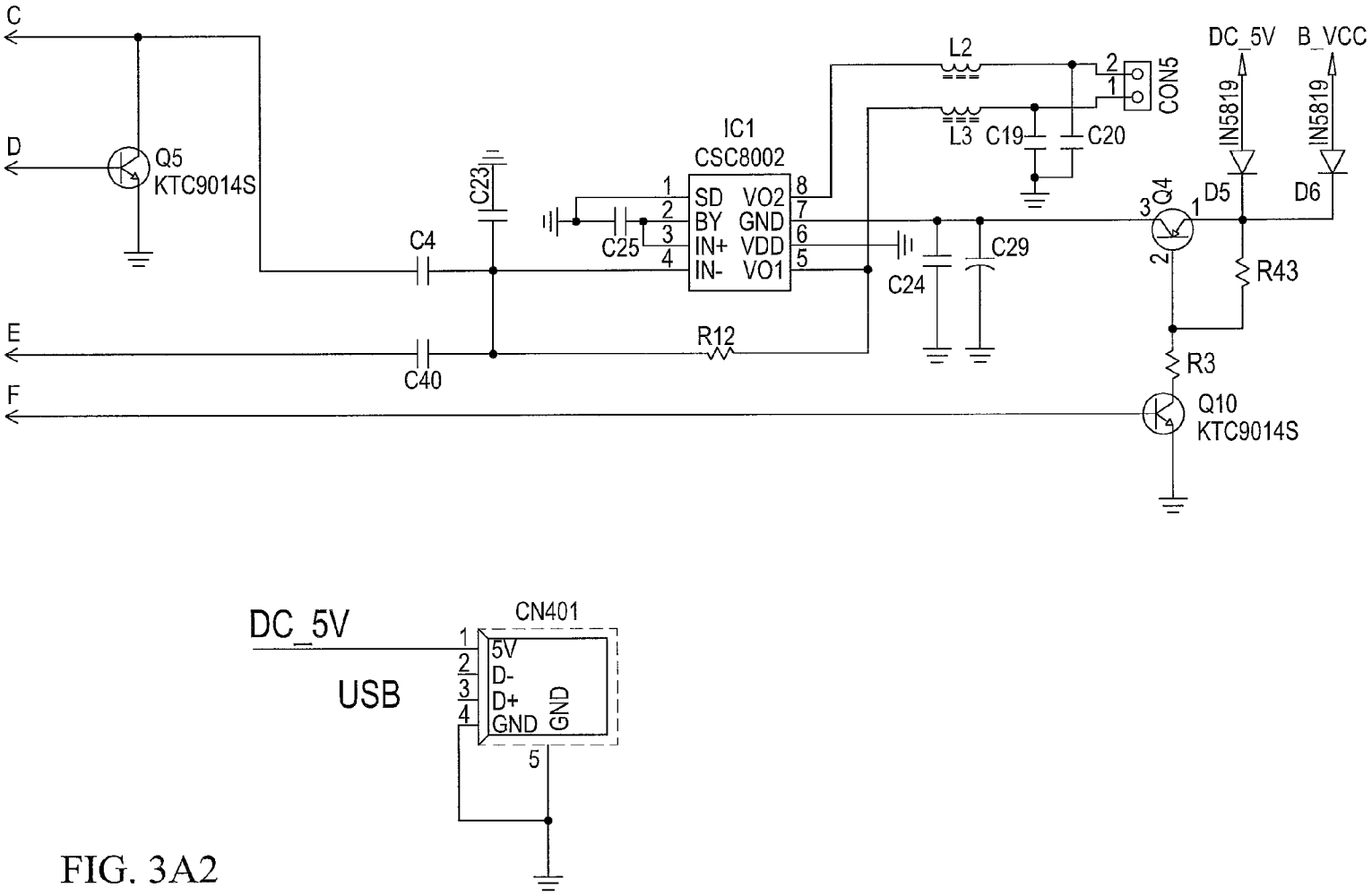
FIG. 3A2

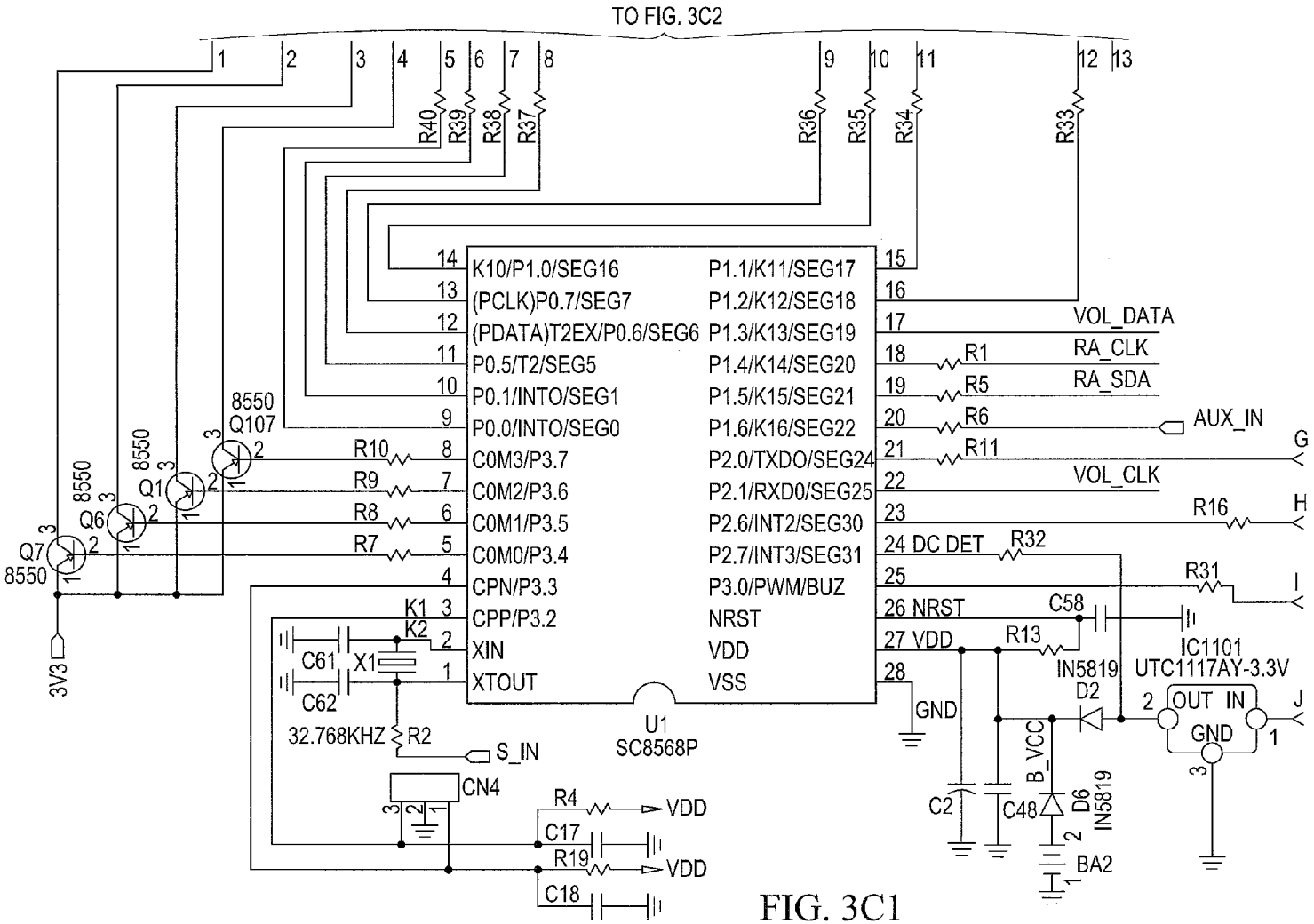
FIG. 3C1

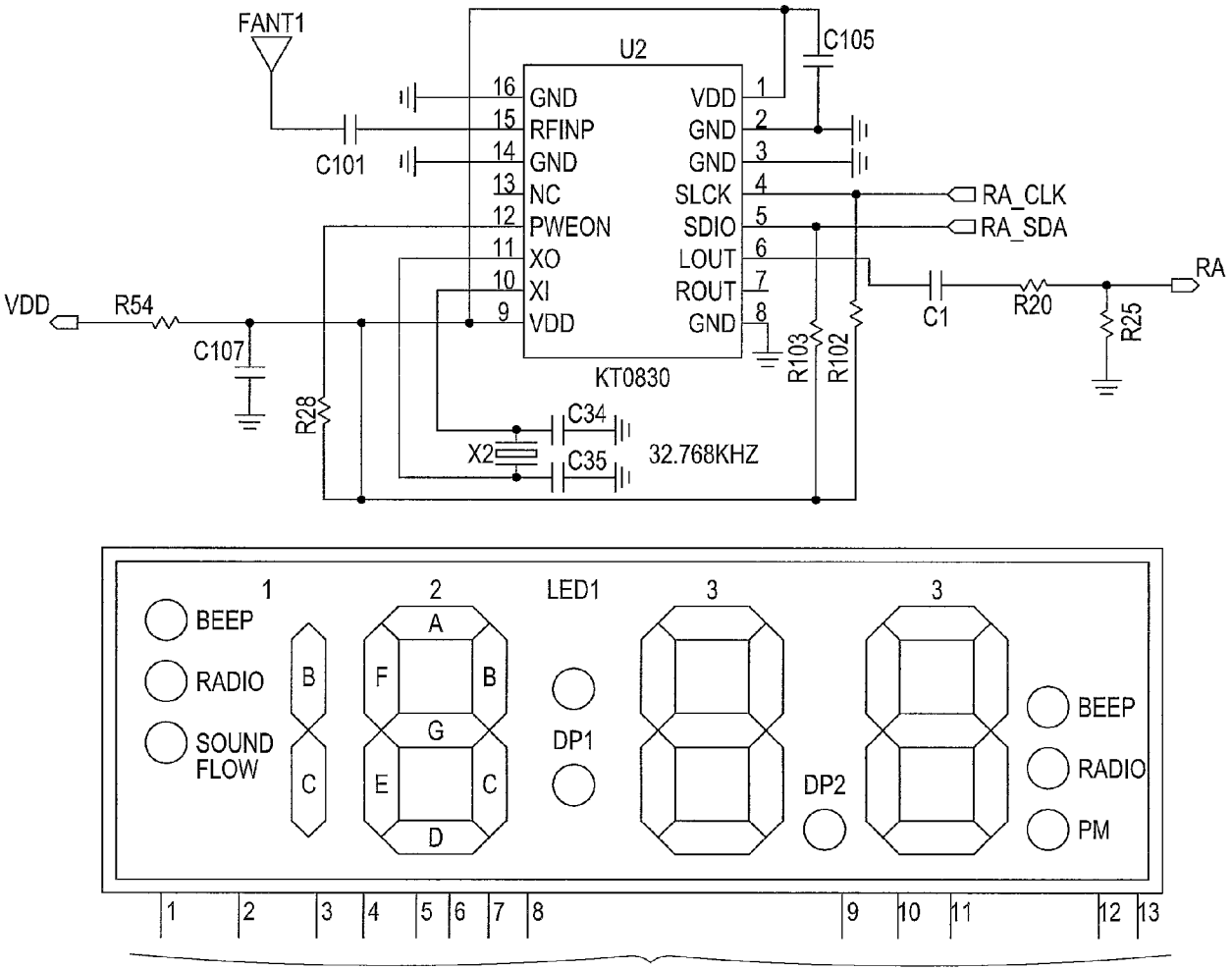
FIG. 3C2

WIRELESS AUDIO COUPLER AND AMPLIFIER FOR MOBILE PHONE, TABLET DEVICE, MP3 PLAYER AND THE LIKE

This application is related to U.S. Provisional Application Ser. No. 61/738,545, filed on Dec. 18, 2012, and entitled "Wireless Audio Coupler and Amplifier for Mobile Phone, Tablet Device, MP3 Player and the Like" and U.S. Provisional Application Ser. No. 61/836,472, filed on Jun. 18, 2013, and also entitled "Wireless Audio Coupler and Amplifier for Mobile Phone, Tablet Device, MP3 Player and the Like", and U.S. Design Patent Application Ser. No. 29/466,502, filed on Sep. 9, 2013, and entitled "Housing for an Electronic Device", the disclosure of each of which is incorporated herein by reference and on which priority is hereby claimed.

BACKGROUND OF THE INVENTION

1. Field of the Invention

The present invention relates to an electronic circuit and method, and an apparatus, for wirelessly coupling one electronic device to another electronic device so that audio signals may be transferred between the devices.

2. Description of the Prior Art

It is known from early modems, facsimile machines and the like that to transfer signals in the audio or audible frequency range between electronic devices, the speaker of one device, often forming part of a telephone handset, is placed in close proximity to the microphone of the other device, often including a cradle in which the handset of the first device is received. Sound emanating from the speaker of the first device is received by the microphone of the second device. The microphone of the second device converts the sound into electrical signals, usable by the circuitry of the second device for carrying out a particular function, for example, amplification or transmission, by the second device.

The conversion of electrical signals to sound in the speaker of the first device, and re-conversion into electrical signals of the received sound by the microphone of the second device, may lead to errors and inaccuracies in the received and re-converted signals in the second device. Furthermore, the microphone of the second device may also be receiving background or ambient noise, which further affects the quality and fidelity of the re-converted electrical signals in the second device.

OBJECTS AND SUMMARY OF THE INVENTION

It is an object of the present invention to provide a wireless audio coupler circuit which can transfer audio signals from one electronic device to another electronic device.

It is another object of the present invention to provide a wireless audio coupler for use with a first electronic device, such as a mobile phone, tablet device, MP3 player and the like, which wireless audio coupler is housed within a second electronic device and which can transfer audio signals from the first electronic device to the second electronic device.

It is still another object of the present invention to provide a wireless audio coupler circuit housed within an amplifier device which effects the transfer of audio signals from a portable, handheld device to the amplifier device without the need to convert the electrical signals to audio (i.e., audible sound) in the first device and re-convert the audio sound to electrical signals in the amplifier device.

It is a further object of the present invention to provide an amplifier device which may be wirelessly coupled to a portable handheld device to receive audio signals therefrom and amplify the audio signals.

It is yet a further object of the present invention to provide a wireless audio coupler circuit or device which overcomes the inherent disadvantages of conventional audio coupling devices.

In accordance with one form of the present invention, an audio coupler circuit for wirelessly coupling a portable, handheld electronic device, such as a mobile phone, tablet device, MP3 player and the like, to an amplifier circuit of a second electronic device, for example, a clock radio, preferably resides in the second device. The audio coupler circuit includes one or more magnetic signal pick-up coils placed at specific locations on or in close proximity to the housing of the second electronic device. An area on the exposed outer surface of the housing is marked to show to a user where he should place his handheld device thereon. The magnetic signal pick-up coil, or coils, are situated in locations where at least one of the pick-up coils would be in close proximity to where the built-in internal speaker of most if not all handheld devices currently on the market is located, when the handheld device is placed on the designated area of the exterior surface of the housing of the second electronic device (e.g., the clock radio). The pick-up coil that is closest to the internal speaker of the handheld device senses the strongest magnetic signal from the speaker coil in the handheld device and, through inductive coupling with the speaker coil, provides a corresponding output signal to the amplifier circuit of the second electronic device. In this way, the audio signal provided to the speaker of the handheld device, when the handheld device is placed on the housing of the second device, is amplified and the audio sound corresponding thereto is played through the speaker of the second electronic device.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1A:
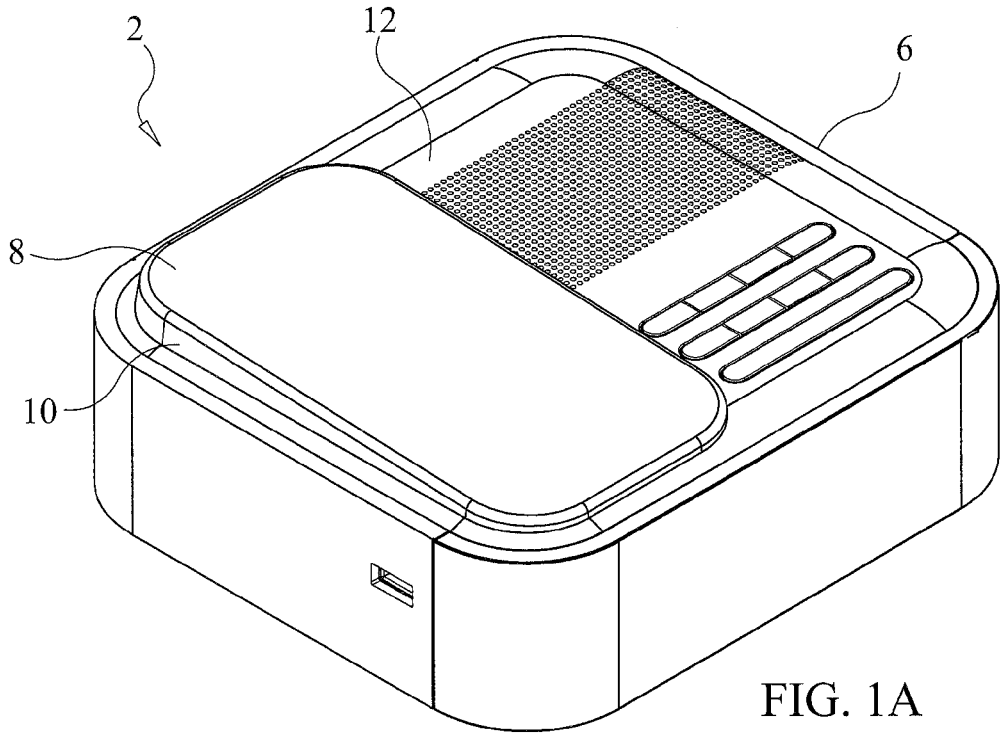
FIGS. 1A and 1B are perspective views of a digital clock radio embodying the wireless audio coupler circuit of the present invention, FIG. 1A illustrating a raised portion of the housing of the digital clock radio on which a portable, handheld electronic device is to be placed, and FIG. 1B showing a portable, handheld device placed on the raised portion of the housing of the digital clock radio, the digital clock radio and wireless audio coupler circuit situated therein being formed in accordance with the present invention.
Figure 1B:
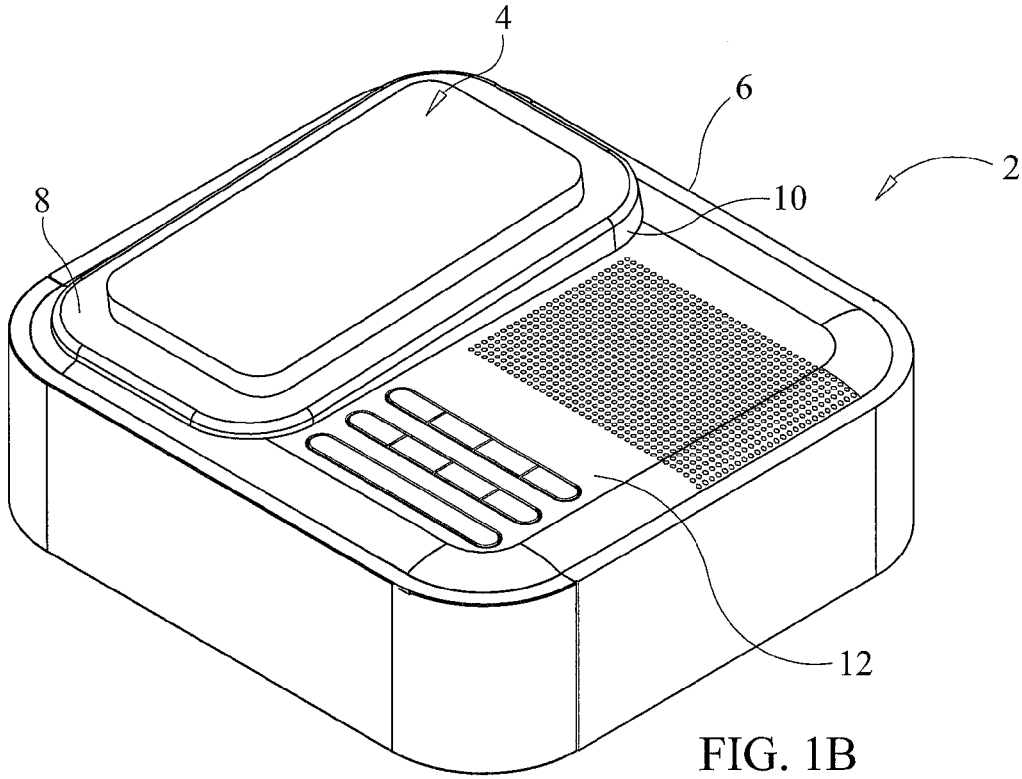
Figure 2:
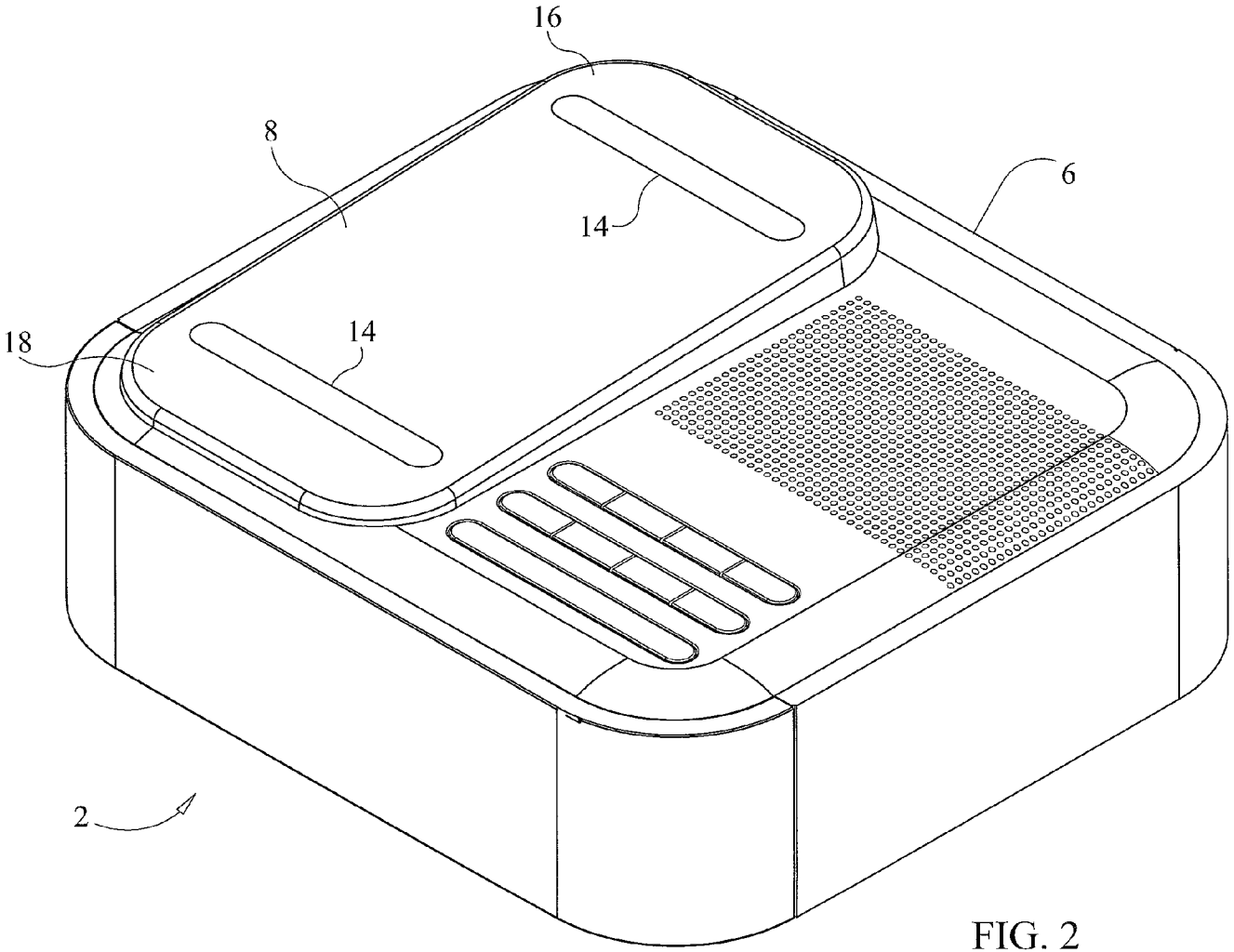
FIG. 2 is a perspective view of an alternative form of the digital clock radio of the present invention, having a raised portion of the housing, and incorporating the wireless audio coupler circuit of the present invention.

Reference should now be had initially to FIGS. 1A, 1B and 2 of the drawings. In each of these figures, a digital clock radio 2 formed in accordance with the present invention is shown. The digital clock radio 2 includes conventional circuitry, as is well known in the art, but also includes the wireless audio coupler circuit 3 of the present invention so that audio signals provided to a speaker 80 (see FIG. 5) of a portable, handheld device 4 may be transferred through inductive coupling to the amplifier circuit within the digital clock radio 2, which can provide amplified audio through the loudspeaker 5 of the clock radio 2 which corresponds to the audio signal provided to the speaker of the handheld device 4.

As can be seen in FIGS. 1A, 1B and 2, the digital clock radio 2 is modified so that its housing 6 has a designated area 8 for the user to place his portable, handheld device 4 thereon. Such a device 4 includes, but is not limited to, a mobile phone, a tablet device and an MP3 player.

The area 8 on the exterior surface on the housing 6, designated for placement of the handheld electronic device 4 thereon, may be slightly raised above the rest of the exterior surface of the housing 6, and may be sloped at an angle, to indicate to a user where to place and orient thereon the handheld device 4. As shown in FIG. 1B, the handheld device 4 is placed on a raised portion 10 of the top surface 12 of the housing 6 of the digital clock radio 2 such that the top of the device 4 is positioned over the higher portion of the raised area 10 of the housing surface 12, and the bottom of the device 4 is positioned at the lower portion of the raised surface area 10. The raised and sloping surface 10 of the housing 6 over this designated area 8 insures that the handheld electronic device 4 will be placed thereon in a particular orientation so that the internal speaker of the portable electronic device 4 will be in close proximity to one or more magnetic signal pick-up coils 11 (or tape heads 13) of the wireless audio coupler circuit 3 forming part of the digital clock radio 2. The portion 10 of the housing 6 over the designated area 8 is also preferably raised so that it is easier for the user to view any messages on the display of the handheld device 4 when it is resting on the housing 6, for example, so that the user may see what song is being played through the speaker of the digital clock radio 2.

Figure 7:
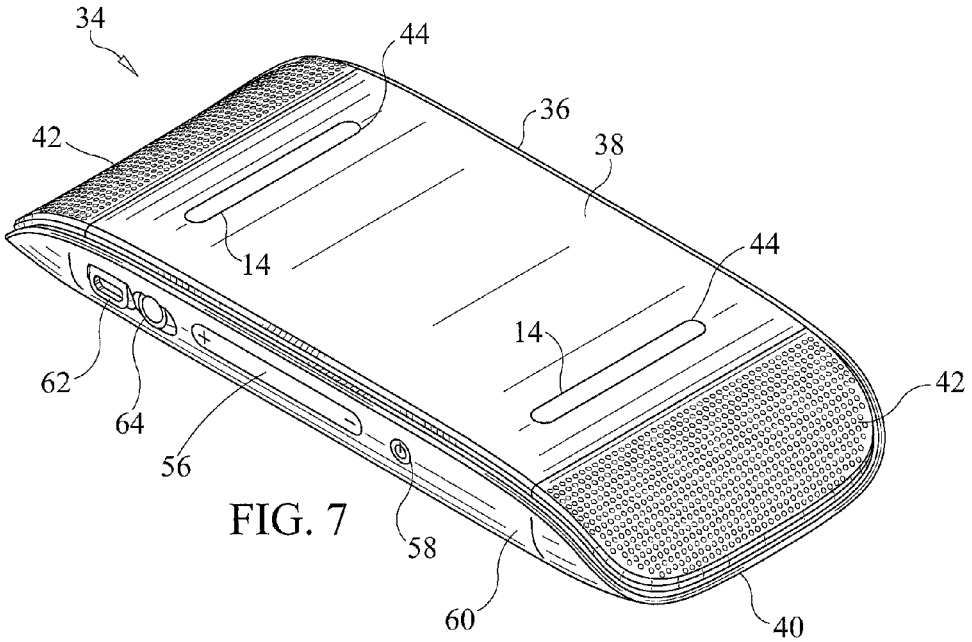
FIG. 7 is a front, top perspective view of another form of an amplifier device including a wireless audio coupler circuit and formed in accordance with the present invention.
Figure 9:
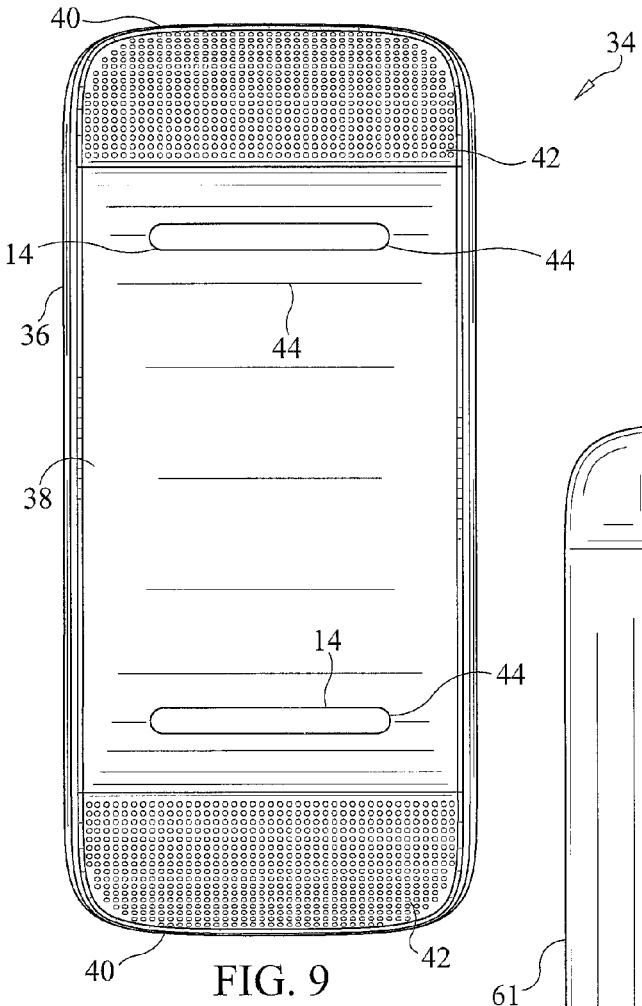
FIG. 9 is a top plan view of the amplifier device of the present invention shown in FIGS. 7 and 8.

Although the designated area 8 shown in FIGS. 1A, 1B and 2 is illustrated as a raised section 10 of the top surface 12 of the housing 6, it is envisioned to be within the scope of the present invention to have an unraised area with markings thereon, such as a rectangular line 14 (see FIGS. 7 and 9) surrounding the area 8, or a recessed area of the housing 6, to indicate to a user where to place his smart phone, cellular phone or other handheld device 4 on the housing 6 of the digital clock radio 2.

There are many brands of smart phones and cellular phones currently on the market. These include the Apple iPhone™, the Samsung Galaxy™, the Blackberry™, the Droid™ phone manufactured by HTC Corporation and mobile phones manufactured by LG Electronics Inc. Each brand of cellular phone and smart phone may have the internal speaker situated in a different location on the housing of the phone (e.g., the top, middle or bottom portion of a smart phone or cellular phone). To insure that maximum coupling between the wireless audio coupler circuit 3 and the speaker coil of the smart phones and cellular phones of each of the major brands, and to insure that the digital clock radio 2 of the present invention, incorporating the wireless audio coupler circuit 3 of the present invention, will work with most major brands of cellular phones and smart phones, a plurality of magnetic signal pick-up coils 11 (or tape heads 13) is used in the audio coupler circuit 3 of the present invention and placed in specific locations within or under the area 8 of the housing 6 of the digital clock radio 2 designated for the user to place his smart phone, cellular phone or other handheld device 4 thereon such that at least one of the magnetic signal pick-up coils 11 will be in close proximity to the internal speaker of the smart phone or cellular phone 4 placed on the designated area 8 of the housing 6 of the digital clock radio 2.

Preferably, three magnetic signal pick-up coils 11 (or tape heads 13) are used in the present invention, one being located directly adjacent to the housing 6, or incorporated in the housing 6, centrally in the top portion 16 of the designated area 8 thereof (near the highest raised portion of the housing 6), and two magnetic signal pick-up coils 11 (or tape heads 13) being situated near the left and right, opposite lateral sides directly adjacent to or incorporated within the lower portion 18 of the designated area 8 of the housing 6 (where the designated area is less raised above the rest of the housing 6 of the digital clock radio 2). The preferred locations of the magnetic signal pick-up coils 11 are determined by the locations of the internal speakers of the smart phones, cellular phones and other portable, handheld devices 4 that are currently being marketed, so that at least one of the magnetic signal pick-up coils 11 will be in close proximity to the internal speaker coil of a cellular phone or smart phone placed in the designated area 8 of the housing 6 of the digital clock radio 2 of the present invention.

It has been found through experimentation that a magnetic signal pick-up coil 11 having an inductance in the range of about ten milliHenries (ten mH) to about three hundred, thirty milliHenries (330 mH) is suitable for use in detecting the magnetic radiation field from the coil of a speaker of a cellular phone or smart phone; however, it has been further found that the best value of inductance of the magnetic signal pick-up coil 11 used in the wireless audio coupler circuit 3 of the present invention is equal or close to the inductance range from about forty milliHenries (40 mH) to about one hundred milliHenries (100 mH). With this inductance, the magnetic signal pick-up coil 11 provides the strongest current and voltage through its inductive coupling with the coil of the internal speaker of the cellular phone or smart phone. As will be explained in greater detail, a cassette head 13 from a conventional cassette tape player may be used as a magnetic signal pick-up device, one or more of the cassette heads 13 being positioned in or in close proximity to the housing 6 within the designated area 8 of the housing of the digital clock radio 2 and at specific locations within the area 8, such as described previously.

The magnetic signal pick-up coil 11 (or tape head 13) should be placed as close as possible to the anticipated location of the speaker of a cellular phone or smart phone placed on the housing 6 of the digital clock radio 2, and it would be preferred if the magnetic signal pick-up coil 11 is within ten millimeters (10 mm) of the speaker coil of the smart phone or cellular phone. If necessary, the thickness of the housing 6 of the digital clock radio 2 over portions of the designated area 8 where the magnetic signal pick-up coils 11 are located may be thinned, with the pick-up coils 11 being situated directly beneath and adjacent to the thinned portions of the housing 6. Alternatively, the magnetic signal pick-up coils 11 may be incorporated directly into the housing 6 of the digital clock radio 2 at specific locations within or in proximity to the designated area 8 to insure sufficient inductive coupling with any cellular phone, smart phone or other portable electronic device 4 placed thereon.

Figure 3B:
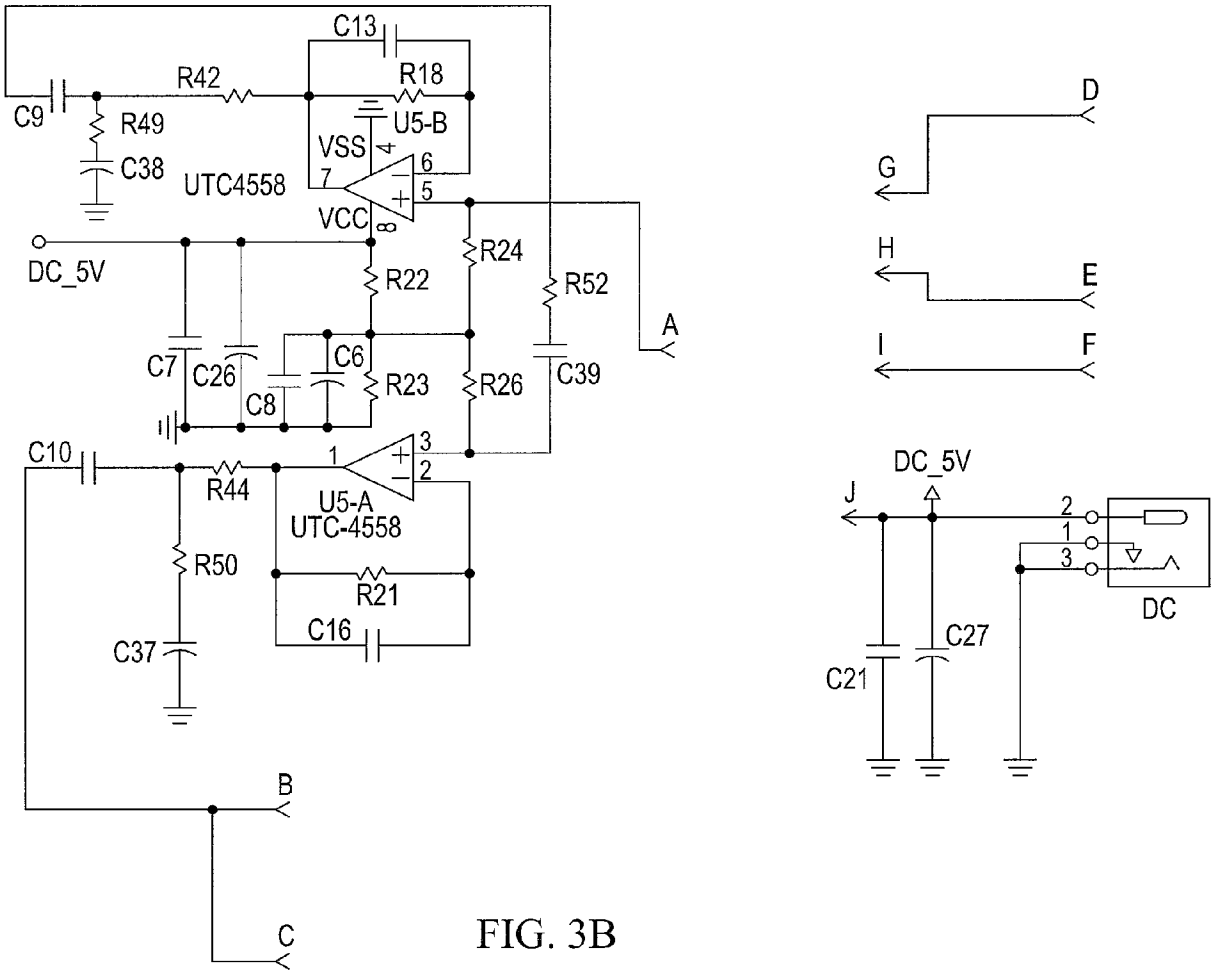
FIG. 3 (i.e., FIGS. 3A1, 3A2, 3B, 3C1 and 3C2) is a schematic diagram of the clock radio of the present invention, showing the wireless audio coupler circuit of the present invention forming part thereof.

A schematic circuit diagram of a digital clock radio 2, modified to include the wireless audio coupler circuit 3 of the present invention, is shown in FIG. 3 (i.e., FIGS. 3A1, 3A2, 3B, 3C1 and 3C2) of the drawings. A major portion of the circuit shown in FIG. 3 is used in a conventional digital clock radio. The modified portion thereof, incorporating the wireless audio coupler circuit 3 of the present invention, will now be described. Nevertheless, it should be realized that the wireless audio coupler circuit 3 of the present invention may be incorporated in other electronic devices, such as cassette tape players, stereo or monoral receivers, and amplifier devices, and is not limited in use to just a clock radio.

Preferably, there are three magnetic signal pick-up coils 11 forming part of the wireless audio coupler circuit 3 of the present invention and incorporated into the electronic circuit of the digital clock radio 2 of the present invention. The three magnetic signal pick-up coils 11 are labeled in FIG. 3 as LA, LC and LD. Each magnetic signal pick-up coil LA, LC, LD is situated in a particular location within the designated area or areas 8 of the housing 6 of the digital clock radio 2 so that at least one of the magnetic signal pick-up coils 11 will be in close proximity to the internal speaker of a cellular phone or smart phone 4 placed on the designated area 8 of the housing 6 of the digital clock radio 2.

One end of each of the magnetic signal pick-up coils LA, LC, LD is grounded, while the other end is provided to a pre-amplifier circuit through a DC blocking capacitor C46, C237 and C357, respectively. Each pre-amplifier circuit is preferably formed using an operational amplifier IC2-B, IC404-A and IC404-B, such as found in dual general purpose operational amplifier integrated circuit RC4558 manufactured by Texas Instruments, or its equivalent. Each operational amplifier IC2-B, IC404-A and IC404-B is configured as an inverting amplifier, including feedback resistors R17, R218 and R318 and input resistors R59, 8219 and R320, respectively. Pre-amplifier circuits are preferably used, since the output signals from the magnetic signal pick-up coils 11 are rather weak, that is, at a very low voltage level.

The amplified output signals of the three pre-amplifier circuits are respectively provided to the RIN2, RIN3 and RIN4 inputs of a four channel digital audio processor IC402, preferably having Part No. PT2314, manufactured by Princeton Technology Corp. The audio processor IC402 acts as a "greatest of" circuit by determining which signal sensed by each magnetic signal pick-up coil LA, LC, LD is the greatest voltage, amplified by the pre-amplifier circuits. The greatest magnitude signal is provided on the right speaker signal output port PIN 23 of the PT2314 circuit IC402, which output signal is provided through the conventional power amplifier circuits of the digital clock radio to the speaker 5 thereof. For more information on the connections and operations of the four channel digital audio processer PT2314 circuit IC402, reference should be had to the data and application sheets and specifications published by Princeton Technology Corp., such as document no. PT2314v1.1, dated March, 1999, and which may be found at http://www.princeton.com.tw, the disclosure of which is incorporated herein by reference.

Figure 6A:
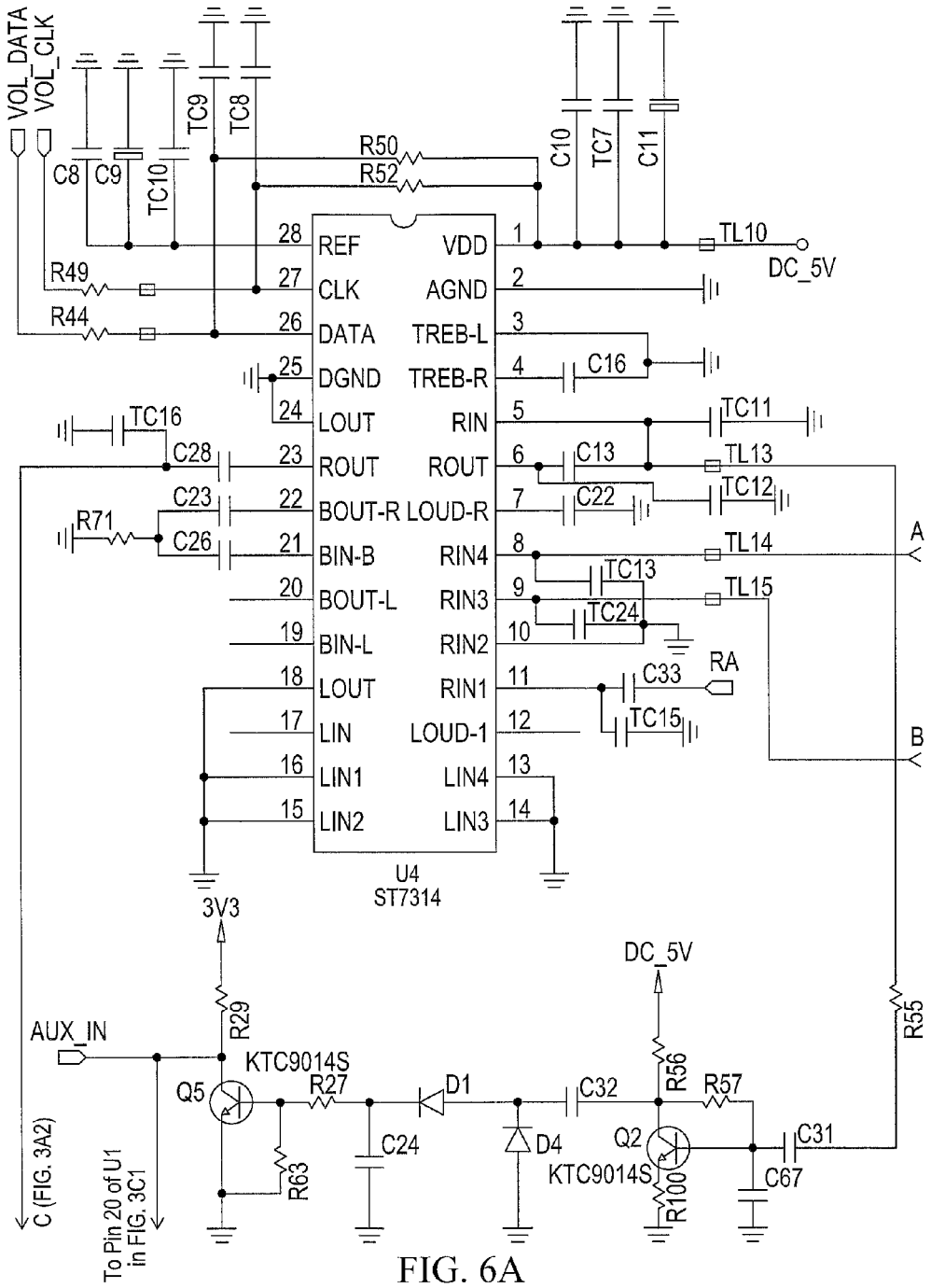
FIG. 6 (i.e., FIGS. 6A and 6B) is a schematic diagram of an alternative version of the wireless audio coupler circuit of the present invention used in the clock radio of the present invention.
Figure 6B:
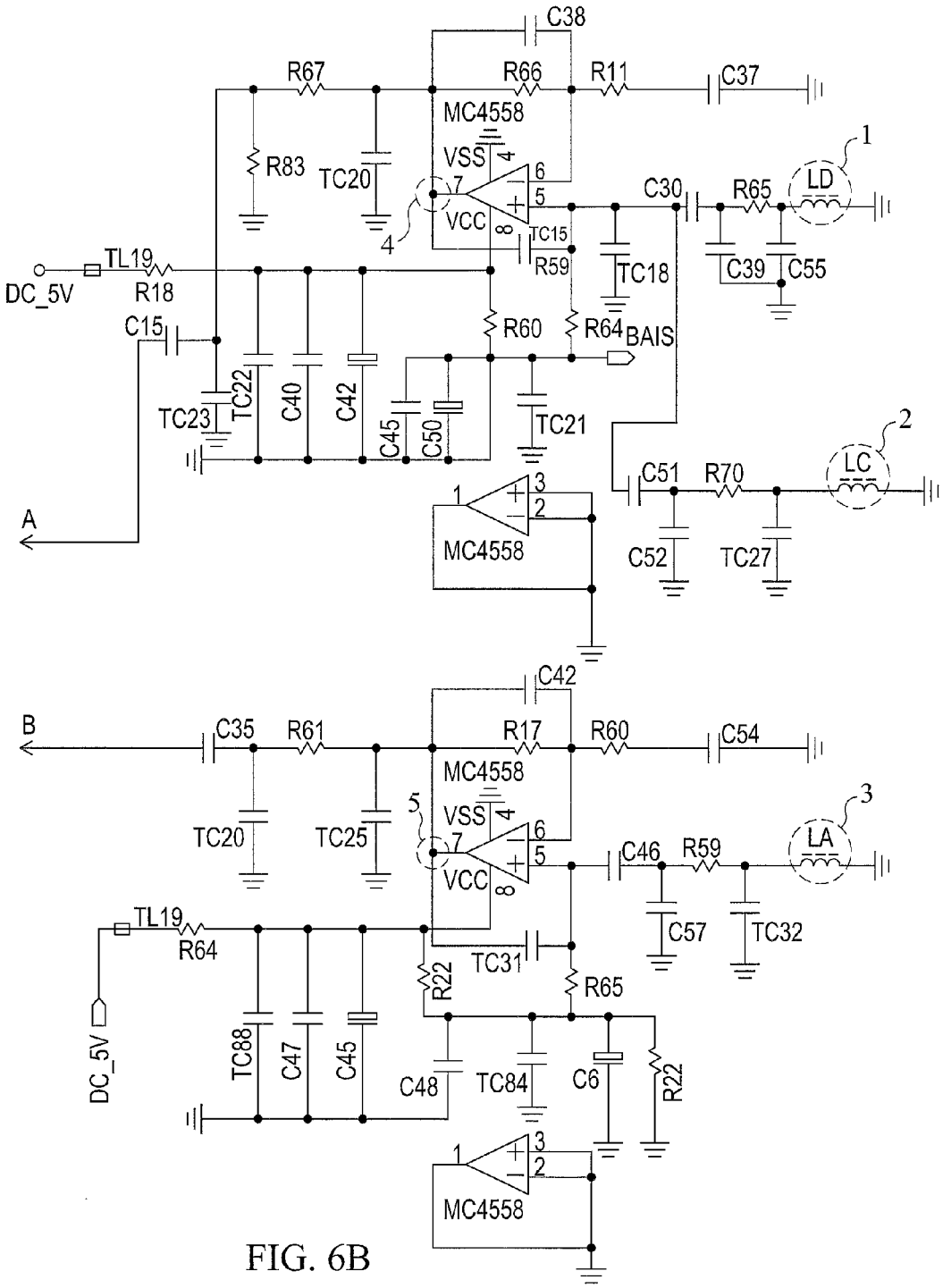

An alternative version of the wireless audio coupler circuit 3 of the present invention used in a clock radio is shown in FIG. 6 (i.e., FIGS. 6A and 6B) of the drawings. Here, a first pre-amplifier circuit formed of an operational amplifier U7-5, preferably forming part of a dual wide bandwidth bipolar operational amplifier integrated circuit, such as having Part No. MC4558 manufactured by STMicroelectronics, or an equivalent thereof by another manufacturer, configured as a non-inverting amplifier, receives on its non-inverting input the corresponding output signal of one of the magnetic signal pick-up coils LA (see Circle 3 in FIG. 6), which preferably has an inductance of forty milliHenries (40 mH). The output of the first pre-amplifier circuit is noted at Circle 5 in FIG. 6, and the output signal thereat is provided to the RIN3 input of the four channel digital audio processor U4, preferably having Part No. PT2314, manufactured by Princeton Technology Corp., as before with the circuit shown in FIG. 3, or its equivalent, such as Part No. ST2314 manufactured by STMicroelectronics.

A second pre-amplifier circuit, being formed of an operational amplifier U6-5, also preferably forming part of a dual operational amplifier integrated circuit having Part No. MC4558, also configured as a non-inverting amplifier, receives on its non-inverting input the summed corresponding output signals of the two other magnetic signal pick-up coils LC and LD (see Circles 2 and 1, respectively, in FIG. 6), each of which also preferably has an inductance of forty milliHenries (40 mH). The output of the second pre-amplifier circuit is noted at Circle 4 in FIG. 6, and the output signal thereat is provided to the RIN4 input of the audio processor circuit U4. As with the wireless audio coupler circuit of FIG. 3, the audio processor U4 will select the strongest amplified signal from either the first pick-up coil LA, or from the combination of the second and third pick-up coils LC and LD, to be amplified by the power amplifier circuitry of the clock radio 2, as described previously in relation to the circuit shown in FIG. 3.

As mentioned previously, a tape head 13 of a conventional cassette tape player may be used instead of a magnetic signal pick-up coil 11. A wireless audio coupler circuit 3, using such a tape head 13, is illustrated by FIGS. 4 and 5 of the drawings.

Figure 4:
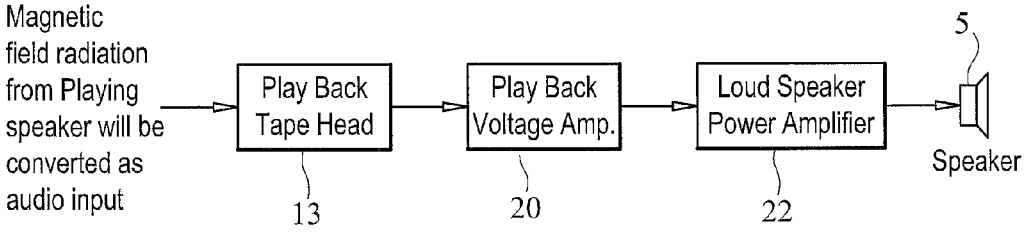
FIG. 4 is a block diagram of an alternative form of the wireless audio coupler circuit and an amplifier circuit formed in accordance with the present invention, which uses a tape head, such as found in a cassette tape player, for magnetically or inductively coupling the speaker of a portable, handheld electronic device to the amplifier circuit formed in accordance with the present invention.

As shown in FIG. 4, the magnetic field radiating from the coil of the internal speaker of a cellular phone, smart phone or other portable, handheld electronic device 4 is picked up (i.e., sensed) by the playback tape head 13 found in a conventional cassette tape player. The output signal from the tape head 13 is provided to an amplifier, such as the playback pre-amplifier 20 found in a conventional cassette tape player, and the output signal of the playback pre-amplifier 20 is provided to the power amplifier 22 of a conventional tape cassette player, whose amplified output signal, in turn, is provided to the loudspeaker 5 of a conventional cassette tape player.

Figure 5:
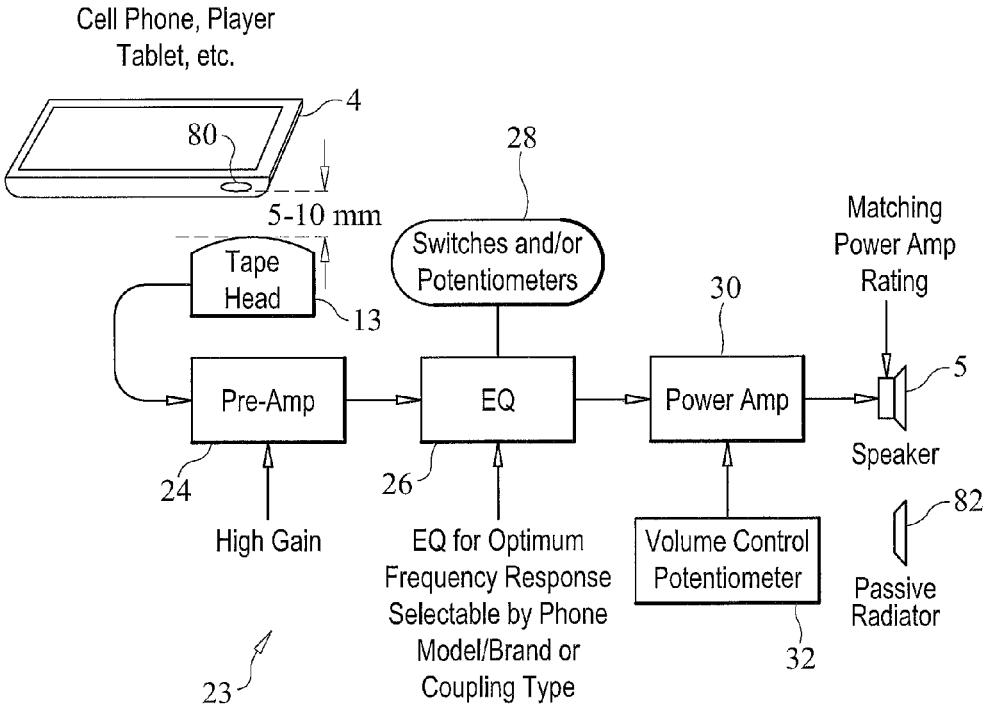
FIG. 5 is another block diagram illustrating the coupling between the wireless audio coupler circuit of the present invention, using a tape head for magnetically or inductively coupling an amplifier circuit to the internal speaker of the handheld electronic device.

An electronic device having the features of a cassette tape player 23 is shown in FIG. 5 of the drawings. The tape head 13 is placed within close proximity to the internal speaker 80 of the cellular phone, tablet device, MP3 player or other electronic handheld device 4 and preferably within a distance therefrom of about ten (10) millimeters or less so that the tape head 13 will be magnetically coupled to the internal speaker 80 of the handheld device 4. The output signal of the tape head 13 is provided to a pre-amplifier circuit 24 having high gain, and preferably the output signal of the pre-amplifier circuit 24 is provided to an equalizer circuit 26. The equalizer circuit 26 is preferably included to provide an optimum frequency response. As is well known, a plurality of switches and/or potentiometers 28 may be connected to the equalizer circuit 26 so that the user may adjust the frequency response over the audio band. The output signal of the equalizer circuit 26 is provided to a power amplifier 30, where volume may be controlled by the user using a potentiometer 32, and the output signal of the power amplifier 30 is provided to a loudspeaker 5.

The circuitry just described, that is, the pre-amplifier circuit 24, equalizer circuit 26 and power amplifier circuit 30, may form part of a conventional cassette tape player 23 that has an area 8 of its housing designated for placement of a cellular phone, smart phone or other portable, handheld device 4, in a manner similar to that described previously with respect to the digital clock radio 2, and the audio signal from the cellular phone or smart phone may be picked up (sensed) by the tape head 13 of the cassette tape player 23, where the tape head 13, or a plurality of tape heads 13, is positioned close to the housing and within the designated area 8 of the housing so that the tape head 13 magnetically couples to the internal speaker 80 of the cellular phone or smart phone placed against the designated area 8 of the housing. Alternatively, it may be that the existing tape head 13 used in the conventional cassette tape player 23 for sensing the magnetic signals on the cassette tapes may be situated sufficiently close to the housing of the player where the handheld device 4 is placed so as to magnetically couple to the internal speaker 80 of the handheld device placed against the housing, and no additional tape heads 13 or magnetic signal pick-up coils 11 need to be incorporated in the cassette tape player 23 modified to incorporate the wireless audio coupler circuit 3 of the present invention.

In an alternative version of the present invention, rather than incorporating the wireless audio coupler circuit 3 in an existing electronic device, such as a digital clock radio 2 or cassette tape player 23 as described previously, a separate amplifier device 34 having the wireless audio coupler circuit 3 incorporated therein may be constructed. The separate amplifier device 34 would include a housing 36 having a designated area 8 on which the user may place his cellular phone, smart phone or other portable, handheld device 4, as described previously. One or more magnetic signal pick-up coils 11 (or tape heads 13) would be disposed at selected locations within the designated area 8 of the housing 36 of the amplifier device 34 to be in close proximity to the internal speaker of the handheld device 4, as also described previously. The amplifier device 34 may include a pre-amplifier circuit 24, an equalizer circuit 26, a power amplifier circuit 30 and one or more loudspeakers 5, as described previously and shown in FIG. 5 of the drawings, so that the audio signals of the speaker coil within the handheld device 4 are inductively or magnetically coupled to the magnetic signal pick-up coils 11 or tape heads 13 of the amplifier device 34, with the output signals from the coils 11 or tape heads 13 being pre-amplified, equalized in frequency response, power amplified and provided to a loudspeaker 5 forming part of the amplifier device 34 so that the user may hear an amplified version of the audio from the internal speaker of his cellular phone, smart phone or other handheld device 4. Such a separate amplifier device 34 is shown by way of example in FIGS. 7-14 of the drawings.

As can be seen from FIGS. 7-14, the amplifier device 34 has a generally planar housing 36 which defines an interior cavity for housing the electronic circuitry described previously, which may include a pre-amplifier circuit 24, an equalizer circuit 26, a power amplifier circuit 30 and one or more loudspeakers 5, as well as the wireless audio coupler circuit 3 also described previously. The top surface 38 of the housing 36 preferably slopes at opposite narrower sides 40, where speaker grills 42 are incorporated into the top surface 38, the grills 42 covering loudspeakers 5 placed beneath them and connected to the internally disposed power amplifier circuit 30. In an alternative embodiment, the amplifier device 34 may include one or more loudspeakers 5 and one or more passive radiators (i.e., a "drone cone", without a magnet and voice coil) 82 situated beneath one or more of the grills 42. If the loudspeaker 5 and passive radiator 82 are remotely located on the housing 36 beneath individual loudspeaker grills 42, they may be acoustically coupled together through the interior cavity defining an internal sound chamber within the amplifier device 34. Markings or other indicia 44, preferably colored lines that define two oblong or rectangular shapes 14 which extend laterally across the top surface 38 of the housing 36, in proximity to the opposite narrower side portions 40 of the housing 36, are provided for the user to know where the magnetic signal pick-up coils 11 are located beneath the top surface 38 of the housing 36 and so that the user may place his smart phone or other electronic device 4 thereon such that the speaker of the smart phone or other electronic device 4 will be in close proximity to one of the magnetic signal pick-up coils 11 located in the amplifier device 34, as indicated by the oblong or rectangular shaped lines 14. This will ensure the best coupling between the speaker of the smart phone or other electronic device 4 and the magnetic signal pick-up coil or coils 11 (or tape heads 13, if such are used) of the amplifier device 34 of the present invention.

Figure 8:
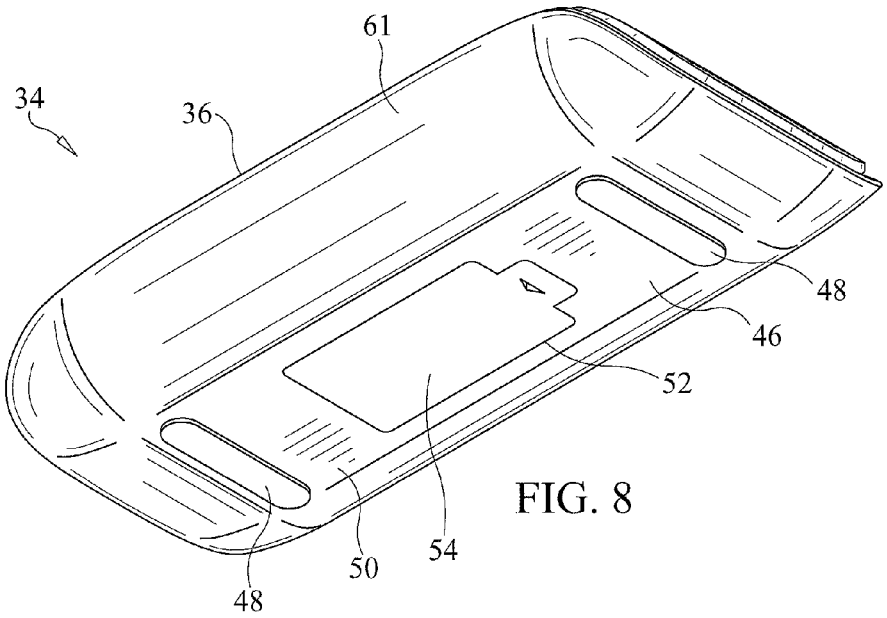
FIG. 8 is a rear, bottom perspective view of the amplifier device of the present invention shown in FIG. 7.
Figure 10:
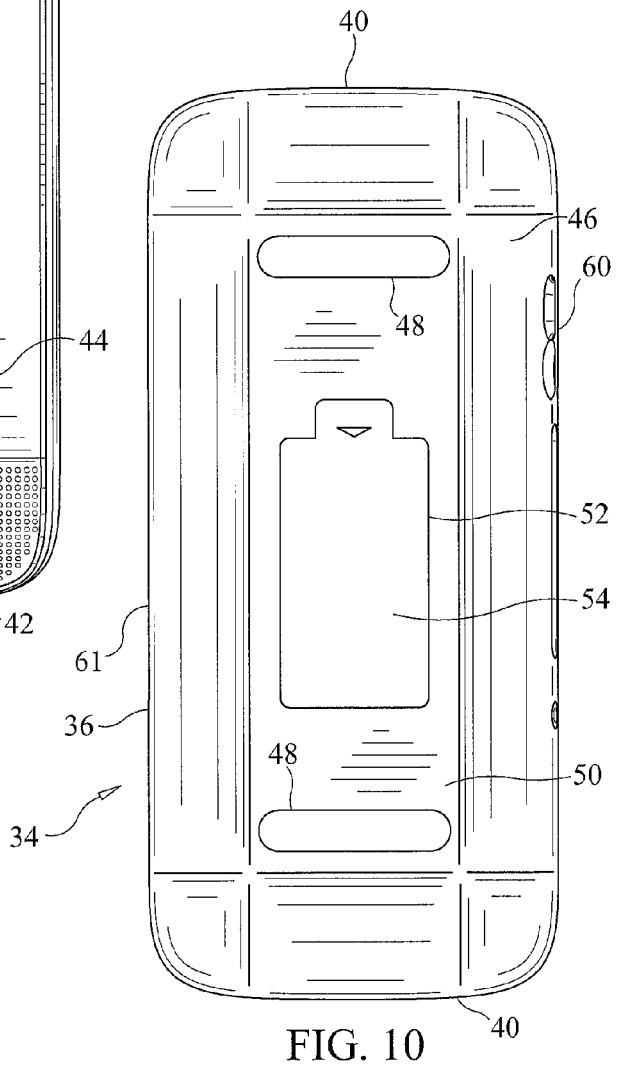
FIG. 10 is a bottom plan view of the amplifier device of the present invention shown in FIGS. 7-9.

The rear side 46 of the amplifier device 34, as shown in FIGS. 8 and 10, includes one or more non-slip rubber feet 48 mounted on the bottom surface 50 thereof, as well as a battery cabinet 52 for housing a battery for powering the amplifier device 34 of the present invention, the battery cabinet 52 being closable with a removable or pivotable door 54 that lies flush with the bottom surface 50 of the amplifier device housing 36.

Figure 11:
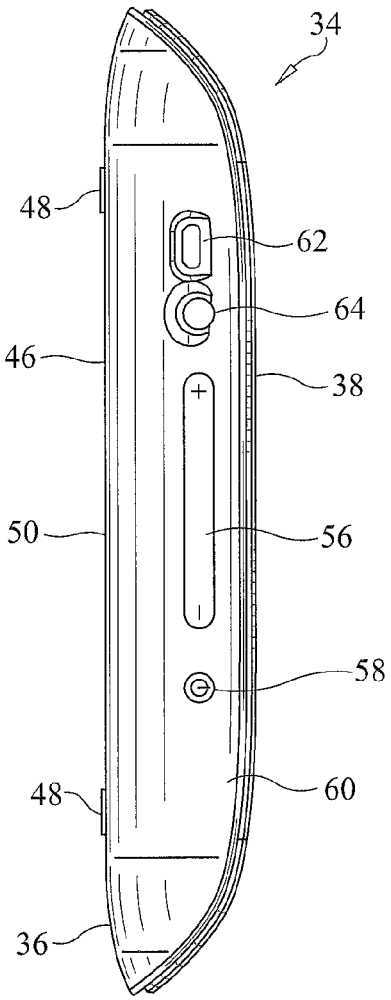
FIG. 11 is an elevational view of a first lateral side of the amplifier device of the present invention shown in FIGS. 7-10.
Figure 12:
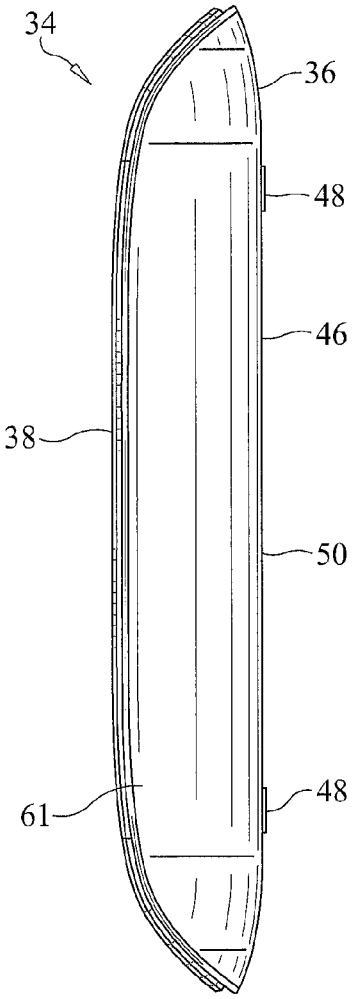
FIG. 12 is an elevational view of a second lateral side of the amplifier device of the present invention shown in FIGS. 7-11.
Figure 13:
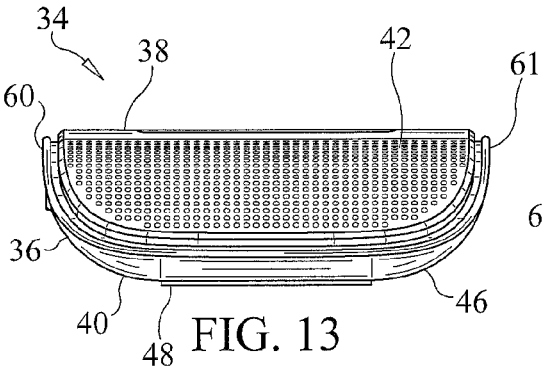
FIG. 13 is an elevational view of a first speaker side of the amplifier device of the present invention shown in FIGS. 7-12.
Figure 14:
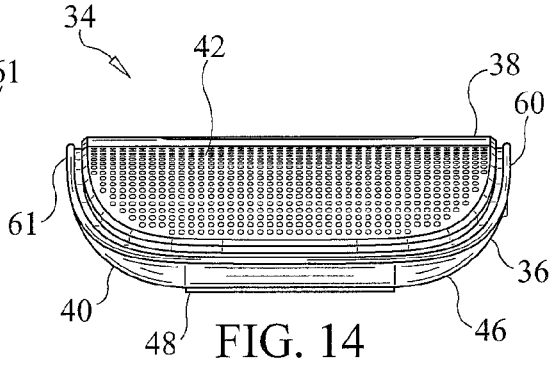
FIG. 14 is an elevational view of a second speaker side of the amplifier device of the present invention shown in FIGS. 7-13.

As can be seen from FIG. 11 of the drawings, the amplifier device 34 of the present invention preferably includes a volume control in the form of a rocker switch 56 for controlling the volume of the sound emitted by the amplifier device 34, as well as a power, push button switch 58 for controlling the energization of the amplifier device 34 of the present invention, each of the switches 56, 58 being mounted on one lateral side 60 of the amplifier device.

On the same or opposite lateral side 61 of the amplifier device 34 of the present invention, and as shown in FIG. 11 of the drawings, preferably the amplifier device 34 includes a micro USB connector 62 for charging the battery of the amplifier device 34 or for powering the amplifier device by an external power source, and an auxiliary jack or other connector 64 for connecting the amplifier device 34 of the present invention to a peripheral speaker or other amplifier circuit or device.

As can be seen from the foregoing description, and as shown in the drawings, the device of the present invention, whether it is in the form of a clock radio 2, cassette tape player 23 or a separate amplifier device 34, having incorporated therein the wireless audio coupler circuit 3, allows a user of a handheld electronic device 4 to easily amplify the sounds emanating from the handheld device through the loudspeaker 5 of the amplifier device wirelessly by simply resting the handheld device 4 on the designated area 8 of the housing of the amplifier device. No wired connection is required, as the speaker coil in the handheld device 4 will be inductively or magnetically coupled to the amplifier device through the strategically placed magnetic pick-up coils 11, 13 of the amplifier device. The handheld device 4 and amplifier device are easily decoupled by removing the handheld device from the designated resting area 8 of the housing of the amplifier device.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electronic amplifier device, which comprises:

a housing, the housing defining an interior space;

an area on the housing designated for placement of a portable electronic device thereon;

an amplifier circuit situated within the interior space defined by the housing;

at least one loudspeaker electrically coupled to the amplifier circuit and situated in proximity to the housing; and a wireless audio coupler circuit situated within the interior space defined by the housing and electrically coupled to the amplifier circuit, the wireless audio coupler circuit including at least one magnetic signal sensing device, the at least one magnetic signal sensing device being situated in close proximity to the designated area on the housing for sensing magnetic signals emanating from the portable electronic device placed on the designated area of the housing.

2. An electronic amplifier device as defined by claim 1, wherein the at least one magnetic signal sensing device includes a magnetic signal pick-up coil.

3. An electronic amplifier device as defined by claim 1, wherein the at least one magnetic signal sensing device includes a playback tape head.

4. An electronic amplifier device as defined by claim 1, wherein the housing includes a raised portion and an unraised portion adjacent to the raised portion, the raised portion of the housing being situated in alignment with the designated area on the housing, the raised portion of the housing being provided for placement of the portable electronic device thereon.

5. An electronic amplifier device as defined by claim 4, wherein the raised portion of the housing is sloped relative to the unraised portion of the housing.

6. An electronic amplifier device as defined by claim 1, wherein the housing includes indicia situated thereon to indicate the area on the housing designated for placement of the portable electronic device thereon.

7. An electronic amplifier device as defined by claim 1, wherein the at least one magnetic signal sensing device includes at least a first magnetic signal sensing device and a second magnetic signal sensing device, each of the at least first magnetic signal sensing device and the second magnetic signal sensing device being spaced apart from one another and being situated in close proximity to the area on the housing designated for placement of the portable electronic device thereon, each of the at least first magnetic signal sensing device and the second magnetic signal sensing device generating sensed output signals in response to magnetic signals sensed by the at least first magnetic signal sensing device and the second magnetic signal sensing device;

wherein the wireless audio coupler circuit further includes at least a first pre-amplifier circuit and a second pre-amplifier circuit, the first pre-amplifier circuit being electrically coupled to the first magnetic signal sensing device, and the second pre-amplifier circuit being electrically coupled to the second magnetic signal sensing device, the at least first pre-amplifier circuit and the second pre-amplifier circuit respectively generating a first pre-amplified output signal and a second pre-amplified output signal respectively in response to the sensed output signals generated by the at least first magnetic signal sensing device and the second magnetic signal sensing device;

and wherein the wireless audio coupler circuit further includes a processing circuit which determines which of the at least first pre-amplified output signal and the second pre-amplified output signal has the greatest magnitude.

8. An electronic amplifier device as defined by claim 1, wherein the housing is in the form of a generally elongated, planar structure having a first narrow side and a second narrow side situated opposite the first narrow side;

wherein the electronic amplifier device further comprises a first loudspeaker grill mounted on the housing and situated in proximity to the first narrow side thereof, and a second loudspeaker grill mounted on the housing and situated in proximity to the second narrow side thereof; and wherein the at least one loudspeaker includes a first loudspeaker and a second loudspeaker, the first loudspeaker being situated in proximity to the first loudspeaker grill, and the second loudspeaker being situated in proximity to the second loudspeaker grill.

9. An electronic amplifier device as defined by claim 1, which further comprises:

at least one loudspeaker grill mounted on the housing, and at least one passive radiator situated in proximity to the at least one loudspeaker so as to be acoustically coupled thereto, at least one of the at least one loudspeaker and the at least one passive radiator being situated in proximity to the at least one loudspeaker grill.

10. An electronic amplifier device as defined by claim 1, which further comprises a digital clock radio circuit.

11. An electronic amplifier device as defined by claim 1, which further comprises a tape cassette player circuit.

12. A method for wirelessly transferring audio signals from a portable electronic device to an electronic amplifier device without the need to convert the audio signals to audio sound in the portable electronic device and re-convert the audio sound to electrical signals in the electronic amplifier device, the electronic amplifier device having a housing, the housing defining an interior space, an area on the housing designated for placement of the portable electronic device thereon, an amplifier circuit situated within the interior space defined by the housing, at least one loudspeaker electrically coupled to the amplifier circuit and situated in proximity to the housing, and a wireless audio coupler circuit situated within the interior space defined by the housing and electrically coupled to the amplifier circuit, the wireless audio coupler circuit including at least one magnetic signal sensing device, the at least one magnetic signal sensing device being situated in close proximity to the designated area on the housing for sensing magnetic audio signals emanating from the portable electronic device placed on the designated area of the housing, which comprises the steps of:

placing the portable electronic device on the area on the housing of the electronic amplifier device designated for placement of the portable electronic device thereon;

sensing by the at least one magnetic signal sensing device of the electronic amplifier device magnetic audio signals generated by the portable electronic device and generating a sensed output signal in response thereto;

amplifying by the amplifier circuit of the electronic amplifier device the sensed output signal and generating an amplified output signal in response thereto; and providing the amplified output signal to the at least one loudspeaker of the electronic amplifier device.

13. A method for wirelessly transferring audio signals from a portable electronic device to an electronic amplifier device without the need to convert the audio signals to audio sound in the portable electronic device and re-convert the audio sound to electrical signals in the electronic amplifier device, the electronic amplifier device including a housing, the housing defining an interior space, an area on the housing designated for placement of the portable electronic device thereon, an amplifier circuit situated within the interior space defined by the housing, at least one loudspeaker electrically coupled to the amplifier circuit and situated in proximity to the housing, and a wireless audio coupler circuit situated within the interior space defined by the housing and electrically coupled to the amplifier circuit, the wireless audio coupler circuit including at least a first magnetic signal sensing device and a second magnetic signal sensing device, each of the at least first magnetic signal sensing device and the second magnetic signal sensing device being spaced apart from one another and being situated in close proximity to the area on the housing designated for placement of the portable electronic device thereon, the at least first magnetic signal sensing device and the second magnetic signal sensing device respectively generating at least a first sensed output signal and a second sensed output signal in response to magnetic audio signals respectively sensed by the at least first magnetic signal sensing device and the second magnetic signal sensing device, at least a first pre-amplifier circuit and a second pre-amplifier circuit, the first pre-amplifier circuit being electrically coupled to the first magnetic signal sensing device, and the second pre-amplifier circuit being electrically coupled to the second magnetic signal sensing device, the at least first pre-amplifier circuit and the second pre-amplifier circuit respectively generating at least a first pre-amplified output signal and a second pre-amplified output signal respectively in response to the at least first sensed output signal and the second sensed output signal generated by the at least first magnetic signal sensing device and the second magnetic signal sensing device, and a processing circuit which determines which of the at least first pre-amplified output signal and the second pre-amplified output signal has the greatest magnitude, which comprises the steps of:

placing the portable electronic device on the area on the housing of the electronic amplifier device designated for placement of the portable electronic device thereon;

sensing by the at least first magnetic signal sensing device and the second magnetic signal sensing device of the electronic amplifier device magnetic audio signals generated by the portable electronic device and respectively generating the at least first sensed output signal and the second sensed output signal in response thereto;

pre-amplifying by the at least first pre-amplifier circuit and the second pre-amplifier circuit of the electronic amplifier device the at least first sensed output signal and the second sensed output signal and respectively generating the at least first pre-amplified output signal and the second pre-amplified output signal in response thereto;

determining by the processing circuit of the electronic amplifier device which of the at least first pre-amplified output signal and the second pre-amplified output signal has the greatest magnitude;

amplifying by the amplifier circuit of the electronic amplifier device one of the at least first pre-amplified output signal and the second pre-amplified output signal which has the greatest magnitude and generating an amplified output signal in response thereto; and providing the amplified output signal to the at least one loudspeaker of the electronic amplifier device.

* * * * *